US009422838B2

(12) United States Patent
Kohler et al.

(10) Patent No.: US 9,422,838 B2
(45) Date of Patent: Aug. 23, 2016

(54) CONTROL VALVE FOR A CAMSHAFT ADJUSTER SYSTEM

(71) Applicant: Schaeffler Technologies AG & Co. KG, Herzogenaurach (DE)

(72) Inventors: David Kohler, Egloffstein (DE); Jens Hoppe, Erlangen (DE); Ali Bayrakdar, Rothenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/435,859

(22) PCT Filed: Jul. 12, 2013

(86) PCT No.: PCT/DE2013/200045
§ 371 (c)(1),
(2) Date: Apr. 15, 2015

(87) PCT Pub. No.: WO2014/059975
PCT Pub. Date: Apr. 24, 2014

(65) Prior Publication Data

US 2015/0267571 A1 Sep. 24, 2015

(30) Foreign Application Priority Data

Oct. 16, 2012 (DE) ..... 10 2012 218 802

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 2001/0475* (2013.01); *F01L 2001/0476* (2013.01); *F01L 2001/34426* (2013.01); *F01L 2001/34433* (2013.01); *Y10T 137/8663* (2015.04)

(58) Field of Classification Search
CPC ..... F01L 1/3442; F01L 2001/34426; F01L 2001/0475; F01L 2001/34433; F01L 2001/0476; Y10T 137/8663
USPC ..... 123/90.17
See application file for complete search history.

(56) References Cited

U.S. PATENT DOCUMENTS 8,522,733 B2 9/2013 Hoppe et al.
2002/0100445 A1 8/2002 Takenaka et al.

(Continued)

FOREIGN PATENT DOCUMENTS

DE 10203634 A1 9/2002
DE 10346443 5/2005

(Continued)

*Primary Examiner* — Zelalem Eshete
(74) *Attorney, Agent, or Firm* — Volpe and Koenig, P.C.

(57) ABSTRACT

A control valve for a hydraulic device, in particular central valve of a camshaft adjuster system for reciprocating-piston internal combustion engines, having a valve sleeve (1) which projects into a cavity of a camshaft (8), wherein a displaceable control piston (3) is arranged in the valve sleeve (1), which control piston is subjected to load on one side by a spring (4) which is adjoined by a pressure medium line. The cavity of the camshaft (8) is connected to a pressure medium supply channel of the reciprocating-piston internal combustion engine via at least one supply line (16) in the camshaft (8) and via a bearing, and the pressure medium line is in the form of a pressure medium feed line and the pressure medium feed line is connected to the pressure medium supply channel of the reciprocating-piston internal combustion engine via a pressure line (12) in the camshaft (8) and via the bearing.

4 Claims, 1 Drawing Sheet

(56) References Cited

U.S. PATENT DOCUMENTS

| | | | | |
|---|---|---|---|---|
| 2005/0066924 | A1 | 3/2005 | Lehmann et al. | |
| 2006/0060159 | A1 * | 3/2006 | Moretz et al. | 123/90.17 |
| 2011/0114047 | A1 | 5/2011 | Hohmann et al. | |
| 2011/0132303 | A1 | 6/2011 | Puetz et al. | |
| 2011/0197835 | A1 | 8/2011 | Boegershausen | |
| 2011/0239966 | A1 | 10/2011 | Strauss | |
| 2012/0199231 | A1 | 8/2012 | Golovatai-Schmidt et al. | |
| 2012/0325169 | A1 | 12/2012 | Draheim | |

FOREIGN PATENT DOCUMENTS

| | | |
|---|---|---|
| DE | 102007058491 | 6/2009 |
| DE | 102008036182 | 2/2010 |
| DE | 102009034011 | 4/2010 |
| DE | 102009052841 A1 | 5/2011 |
| DE | 102010012479 | 9/2011 |
| WO | 2011045368 | 4/2011 |

* cited by examiner

CONTROL VALVE FOR A CAMSHAFT ADJUSTER SYSTEM

FIELD OF THE INVENTION

A control valve for a hydraulic device, in particular central valve of a camshaft adjuster system for reciprocating-piston internal combustion engines, with a valve sleeve which projects into a cavity of a camshaft, wherein a displaceable control piston is arranged in the valve sleeve, said control piston is loaded on one side by means of a spring, which is adjoined by a pressurizing medium line.

BACKGROUND

Such a control valve with a valve sleeve is known from DE 10 2007 058 491 A1. The control valve is a component of a device for variable adjustment of the control times of gas exchange valves on reciprocating-piston internal combustion engines. It is screwed into a camshaft which is formed to be hollow at the end and, in combination with the control piston, controls the pressurizing medium inflow, the control lines which lead to a camshaft adjuster unit and the pressurizing medium outflow which is connected to a pressurizing medium line. In the case of this control valve, the pressurizing medium inflow is carried out in the region of the outer end of the valve sleeve by a stationary housing part of the internal combustion engine so that the installation and the configuration of the adjuster system are structurally highly restricted.

The problem furthermore exists that pressurizing medium can unintentionally flow back out of the control valve or the camshaft adjuster when the reciprocating-piston internal combustion engine is at a standstill, and the drainage of the lines and the adjusting chambers causes an unintentional adjustment of the control times.

It is furthermore generally known to supply a hollow camshaft through a bearing connected to a pressurizing medium supply channel, wherein at least one radial supply line is provided from the bearing surface.

It is important here for the durability of the camshaft mounting that oil pressure is present at the bearings in as short a time as possible after starting the engine.

SUMMARY

The object of the invention is to improve a control valve and in particular a valve sleeve so that on one hand the camshaft mounting is supplied quickly enough with pressurizing medium/lubricant and on the other hand the control valve and thus the camshaft adjuster are likewise supplied with pressurizing medium by simple means. The oil volume of the camshaft adjuster system and of the control valve should also be separated from the oil supply of the camshaft.

The object of the invention is achieved in that the cavity of the camshaft is connected by means of at least one supply line in the camshaft and by means of a bearing to a pressurizing medium supply channel of the reciprocating-piston internal combustion engine and that the pressurizing medium line is formed as a pressurizing medium inflow line and the pressurizing medium inflow line is connected by means of a pressure line in the camshaft and by means of the bearing to the pressurizing medium supply channel of the reciprocating-piston internal combustion engine.

It is ensured as a result that the control valve and the camshaft adjuster are also supplied with pressurizing medium via the bearing and the pressurizing medium supply channel of the reciprocating-piston internal combustion engine independently of the pressurizing medium supply of the camshaft. This involves a significant simplification since the pressurizing medium supply is carried out via a single pressurizing medium supply channel and a bearing, wherein a pressure line is provided from the bearing to the pressurizing medium inflow line and a supply line is provided to the camshaft. It should be expressly pointed out that separate pressurizing medium supplies to the bearing point can also be provided. The bearing preferably is the end bearing of the camshaft adjacent to the camshaft adjuster.

In a further configuration of the invention, it is provided that the at least one supply line and the at least one pressure line are arranged next to one another within the bearing radially in the camshaft. As a result, the supply of the camshaft and of the camshaft adjuster is carried out simultaneously via the pressurizing medium supply channel of the reciprocating-piston internal combustion engine and a bearing.

Normally, not only one supply line and one pressure line are fixed on grooves on the bearing point of the camshaft, rather several are provided so that pressurizing medium can continuously reach the camshaft and the camshaft adjuster.

In a further configuration of the invention, it is provided that the valve sleeve extends within the camshaft at least up to the supply line and that the valve sleeve separates the supply lines from the pressure lines. This is carried out, for example, by means of an O-ring which seals off the valve sleeve from the inner wall of the hollow camshaft. The O-ring is arranged in a groove of the valve sleeve for easier assembly. As a result of the decoupling of the pressurizing medium supply to the control valve and the camshaft adjuster and the camshaft, it is ensured that the camshaft adjuster and the control valve do not drain and that furthermore pressurizing medium is present at the bearings of the camshaft in as short a time as possible after the start of the reciprocating-piston internal combustion engine. The pressurizing medium supply of the camshaft and its bearings is advantageously carried out via at least one radial bore and one axial bore in the valve sleeve which connect the supply line or supply lines to the cavity of the camshaft. The pressurizing medium supply of the control valve and of the camshaft adjuster has a blind bore (10) at the pressurizing medium inflow line and radial bores.

BRIEF DESCRIPTION OF THE DRAWINGS

For further explanation of the invention, reference is made to the drawings in which an exemplary embodiment of the invention is represented in a simplified form. In the drawings.

DETAILED DESCRIPTION OF THE PREFERRED EMBODIMENTS

Figure 1:
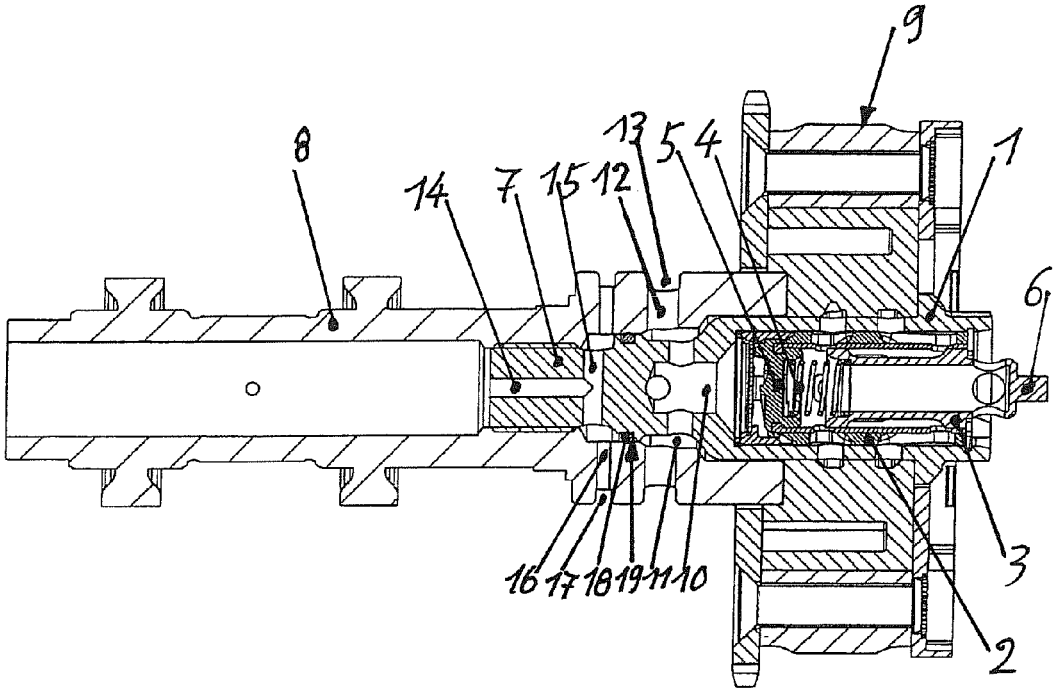
FIG. 1: shows a section through a control valve with valve sleeve, a camshaft adjuster and a camshaft.
Figure 2:
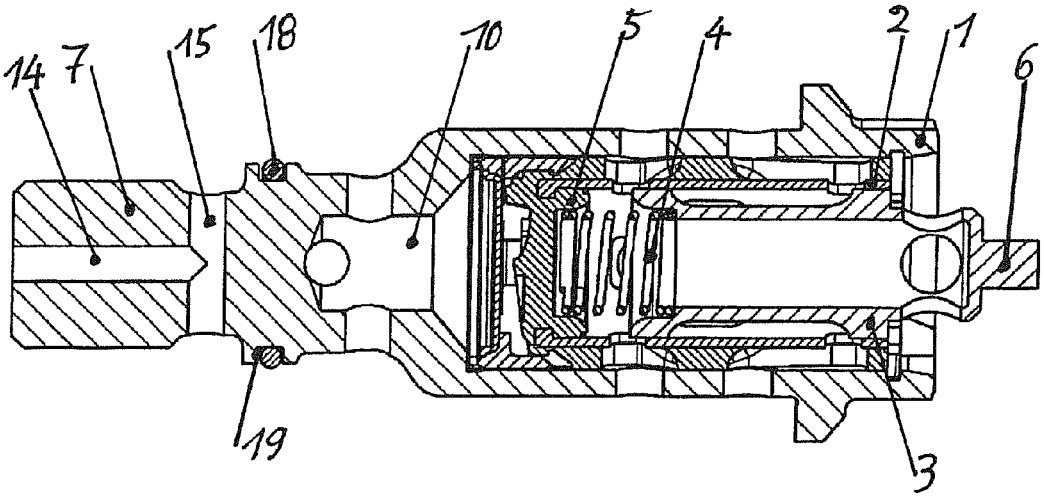
FIG. 2: shows a section through the control valve with valve sleeve.

In FIGS. 1 and 2, in so far as represented in detail, 1 designates a valve sleeve in which a control sleeve 2 is inserted in which itself a control piston 3 is arranged and mounted axially displaceably. The control piston 3 is operatively connected to a spring 4 which is supported on a spring bearing 5. The spring bearing 5 is supported on the control sleeve 2.

The control piston 3 has a head 6 to which, not represented, an actuator corresponds which can displace the control piston 3 counter to the force of the spring 4 and thus controls cross-sections of the pressurizing medium inflow, of the control lines and the pressurizing medium outflow. The valve sleeve 1 has an extension neck 7 on the inner end of which a thread is incorporated to which the valve sleeve 1 can be screwed into a camshaft 8. The camshaft 8 is embodied to be hollow. The valve sleeve 1 further carries a camshaft adjuster 9, not described in greater detail, which is hydraulically operatively connected to the valve sleeve 1. The valve sleeve 1 furthermore has in its interior a blind bore 10 which is connected to the inner space of the valve sleeve. Radial bores are connected to the blind bore 10, which radial bores lead to an annular space 11 to which two pressure lines 12 in the camshaft 8 are connected which lead to a groove 13 in the camshaft 8. The valve sleeve 1 furthermore has an axial bore 14 to which a radial bore 15 is connected which likewise leads to an annular space to which are connected supply lines 16 in the camshaft 8 which extend up to a circumferential groove 17 in the camshaft 8. An O-ring 18 is installed on the valve sleeve between the radial bore 15 and the bores on the blind bore 10, which O-ring 18 seals off with the inner wall of the camshaft. The O-ring 18 is itself inserted in a guide groove 19 in order to ensure a reliable guidance of the O-ring 18 during assembly.

It is ensured as a result of this configuration of the valve sleeve 1 and the camshaft 8 that a pressurizing medium inflow and outflow is decoupled from the pressurizing medium supply channel of the internal combustion engine via the bearing and the pressure lines 12 and the supply lines 16.

LIST OF REFERENCE NUMBERS

1 Valve sleeve
2 Control sleeve
3 Control piston
4 Spring
5 Spring bearing
6 Head
7 Extension neck
8 Camshaft
9 Camshaft adjuster
10 Blind bore
11 Annular space
12 Pressure lines
13 Groove
14 Axial bore
15 Radial bore
16 Supply lines
17 Circumferential groove
18 O-ring
19 Guide groove

The invention claimed is:

1. A control valve for a camshaft adjuster system for reciprocating-piston internal combustion engines, comprising a valve sleeve which projects into a cavity of the camshaft, a displaceable control piston arranged in the valve sleeve, said control piston is loaded on one side by a spring, which is adjoined by a pressurizing medium line, the cavity of the camshaft is connected by at least one supply line in the camshaft and a bearing to a pressurizing medium supply channel of the reciprocating-piston internal combustion engine and the pressurizing medium line is formed as a pressurizing medium inflow line and the pressurizing medium inflow line is connected by at least one pressure line in the camshaft and the bearing to the pressurizing medium supply channel of the reciprocating-piston internal combustion engine, a separation is provided by an O-ring which seals off the valve sleeve from an inner wall of the camshaft, and the O-ring is arranged axially between the at least one supply line and the at least one pressure line, the O-ring is inserted into a guide groove of the valve sleeve, and the O-ring and the guide groove are arranged axially between a first radial bore and a second radial bore of the valve sleeve.

2. The control valve as claimed in claim 1, wherein the at least one supply line and the at least one pressure line are arranged next to one another within a bearing region in the camshaft.

3. The control valve as claimed in claim 1, wherein the valve sleeve extends within the camshaft at least up to the supply line and the pressurizing medium inflow line has a blind hole and radial bores which are connected separately from the at least one supply line to the at least one pressure line.

4. The control valve as claimed in claim 1, wherein at least one radial bore and an axial bore are provided in the valve sleeve which connect the supply lines to the cavity of the camshaft.

* * * * *